US006257006B1

(12) United States Patent
Nagaoka

(10) Patent No.: US 6,257,006 B1
(45) Date of Patent: Jul. 10, 2001

(54) COOLING METHOD AND COOLING APPARATUS

(76) Inventor: Moritoshi Nagaoka, Urban Hills Shonan Hiratuka No.2 Miyanome, Hiratuka-shi, Kangawa-ken, 254-0035 (JP)

( * ) Notice: Subject to any disclaimer, the term of this patent is extended or adjusted under 35 U.S.C. 154(b) by 0 days.

(21) Appl. No.: 09/308,977

(22) PCT Filed: Mar. 25, 1998

(86) PCT No.: PCT/JP98/01314

§ 371 Date: May 28, 1999

§ 102(e) Date: May 28, 1999

(87) PCT Pub. No.: WO99/49267

PCT Pub. Date: Sep. 30, 1999

(51) Int. Cl.[7] ..... F25B 39/02

(52) U.S. Cl. ..... 62/176.3; 62/515; 62/272

(58) Field of Search ..... 62/176.1, 176.3, 62/176.6, 226, 227, 229, 272, 515; 165/222, 223, 227, 230, 913; 236/44 R, 44 A, 44 C

(56) References Cited

U.S. PATENT DOCUMENTS

| | | | | |
|---|---|---|---|---|
| 4,118,946 | * | 10/1978 | Tubin | 62/514 R |
| 4,182,133 | * | 1/1980 | Haas et al. | 62/93 |
| 4,690,209 | * | 9/1987 | Martin | 165/150 |
| 4,746,479 | * | 5/1988 | Hanaki et al. | 264/62 |
| 5,345,776 | * | 9/1994 | Komazaki et al. | 62/176.3 |
| 5,435,155 | * | 7/1995 | Paradis | 62/515 |
| 5,992,508 | * | 11/1999 | Lowenstein et al. | 165/46 |

FOREIGN PATENT DOCUMENTS

| | | | |
|---|---|---|---|
| 51-120457 | | 10/1976 | (JP) . |
| 61-186070 | | 11/1986 | (JP) . |
| 1-107609 | | 7/1989 | (JP) . |
| 4-240373A | * | 8/1992 | (JP) . |
| 5-25187 | | 4/1993 | (JP) . |
| 7-91704 | | 4/1995 | (JP) . |

* cited by examiner

*Primary Examiner*—Harry B. Tanner
(74) *Attorney, Agent, or Firm*—Michaelson & Wallace; Peter L. Michaelson

(57) ABSTRACT

In a cooling apparatus for cooling air, in order to improve heat absorption by a refrigerant, a metal having a high heat conductivity such as copper or aluminum is generally utilized as a constituent material of a heat exchanger. However, due to high heat conductivity, the temperature of a refrigerant becomes equal to the surface temperature of the heater exchanger, so that a space inside a refrigerator or a room is dried. Further, since the amount of latent heat of air decreases due to drying, cooling cannot be effected unless a temperature difference of 10° C. or more is produced between the inlet and outlet of the heat exchanger.

An object of the present invention is to realize a cooling apparatus which does not decrease humidity and which produces a smaller temperature difference between an inlet and an outlet of a heat exchanger, i.e., reduces energy loss. In order to achieve the object, in the cooling apparatus of the present invention, a material having a low heat conductivity is employed as a material of a heat exchanger. Due to employment of a material having a low heat conductivity, the temperature at the surface of the heat exchanger becomes higher than that of the refrigerant, so that the dew-point temperature increases. Therefore, the humidity of the space inside the refrigerator or the room is not decreased. Further, since the humidity of the space inside the refrigerator or the room is not decreased, the amount of latent heat of air does not decrease, so that sufficient cooling can be performed even when only a small temperature difference is produced between the inlet and outlet of the heat exchanger.

26 Claims, 4 Drawing Sheets

COOLING METHOD AND COOLING APPARATUS

TECHNICAL FIELD

The present invention relates to an apparatus for cooling air through use of a heat exchanger, and more particularly to a cooling method and cooling apparatus which can maintain the relative humidity in a refrigerator or a room at a level close to 100%, which improves energy efficiency, and which allows humidity control.

BACKGROUND ART

In order to cool air, there has conventionally been employed a method in which from, a refrigerant that substitutes for fron, water, a thermal accumulating medium, or an antifreeze agent is caused to flow through a heat exchanger disposed inside a refrigerator or a room, and in which forced circulation or free convection of air is caused such that air passes through the heat exchanger in order to cool the air. Also, in order to obtain a high humidity, there has been developed and employed a cooling method, called a "chilled scheme" in which cooling is effected over an entire wall surface through use of a similar refrigerant. Further, a cooling scheme based on the Peltier effect or the like has recently come into use.

In order to improve heat absorption by a refrigerant, a metal having a high heat conductivity such as copper or aluminum is utilized as a constituent material of a heat exchanger. In a Peltier element as well, heat exchange is performed through a metal or ceramic having a high heat conductivity. In such case, due to high heat conductivity, the temperature of a refrigerant becomes equal to the surface temperature of a heater exchanger, and in the case of fron, the surface temperature is determined by the evaporating temperature of fron. This holds true in the case where water, a thermal accumulating agent, or an antifreeze agent is used; in such a case the temperature of the water, thermal accumulating agent, or antifreeze agent becomes equal to the surface temperature of the heat exchanger.

Humid air has been known to contain water vapor. Although the amount of water vapor in humid air is 1–2% by weight or less, the latent heat of the water vapor has an effect that must be taken into account in the design of a cooling method and a cooling apparatus, because evaporation and condensation occur even at room temperature. The maximum amount of water vapor contained in air increases with temperature. Air containing the maximum amount of water vapor is called saturated air, whose absolute humidity is the highest for the given temperature and pressure. When air in a certain state is cooled to have a decreased temperature, the air comes into a saturated state, so that water vapor condenses. The temperature at which air comes into a saturated state is called the dew-point temperature. When wet air is cooled to a temperature below the dew-point temperature, water vapor condenses so that a phenomenon of dew formation occurs. Changes in the state of air in a conventional cooling apparatus will be described with reference to an air chart of FIG. 1. Point A indicates a state in which air has an absolute humidity $x_1$ and a temperature $T_1$. In order to cool the air, the air is circulated over a heat exchanger having a surface temperature $t_d$ equal to the temperature $t_d$ of a refrigerant. As indicated by the solid line E, the temperature of the circulated air—which flows along the surface of the heat exchanger—changes from $T_1$ to $T_2$, while the humidity changes from $x_1$ to $x_3$, so that the air reaches an equilibrium point D. By this time, the absolute humidity of the air has decreased to a value corresponding to the maximum amount of water vapor that can exist at the surface temperature $t_d$ of the heat exchanger, which is identical to the temperature of the refrigerant, so that the relative humidity of the circulated air decreases accordingly. In the conventional cooling scheme in which the surface temperature of the heat exchanger becomes equal to the temperature of the refrigerant, since the surface temperature of the heat exchanger decreases and the dew-point temperature decreases accordingly, the absolute humidity of air decreases, resulting in a dehumidification operation. Accordingly, in such an heat exchange system, moisture within air is cooled excessively and thereby dew-condensed, and dewed moisture is discharged to the outside in the form of water or frost. In other words, energy is wasted.

Meanwhile, the specific enthalpy of wet air is known to increase with the absolute humidity even at constant temperature. When air is subjected to heat exchange by a conventional heat exchanger, the air is dried, and the amount of latent heat in the air decreases considerably. Therefore, a temperature difference of 10° C. or more between the inlet and outlet of the heat exchanger has been considered a necessary condition for effecting cooling. That is, since the amount of latent heat of air is small, a required temperature cannot be maintained unless a certain temperature difference is provided for the internal and external thermal loads. Accordingly, when cooling is performed through use of the conventional heat exchanger, air is dried and energy is wasted, due to the very nature of the heat exchanger.

When the conventional cooling apparatus and cooling method are applied to a cooling apparatus in which a refrigerant is caused to flow through a heat exchanger disposed in a refrigerator or room in order to perform heat exchange, the space inside the refrigerator or room is dried, and in the case of the refrigerator, the cooling apparatus and cooling method are not suitable for storage of flesh foods for a prolonged period of time. In the case of cooling the space inside the room, air is dried excessively, so that a larger amount of moisture transpires from the skin, which causes cooling-related diseases. Further, as described above, moisture within air is cooled and discharged outside a refrigerator or room in the form of water, resulting in loss of energy.

DISCLOSURE OF THE INVENTION

Recalled here is cooling by use of ice. Conventional cooling through use of ice is known to provide a high humidity. In cooling through use of ice, the melting temperature of the ice is constant, and the surface temperature of the ice is always constant. That is, while heat is exchanged between the ice and air, heat is absorbed by the ice at the surface thereof in the form of heat of fusion. Therefore, during heat exchange between the ice and air, the dew-point temperature is constant, and only the temperature of the air changes without a decrease in the humidity of the air, so that cooling can be effected while a high humidity is maintained.

An object of the present invention is to realize a cooling apparatus which does not decrease humidity as in the case of ice, and which produces a smaller temperature difference between an inlet and an outlet of a heat exchanger, i.e., reduces energy loss. In order to achieve the object, in a cooling method and cooling apparatus of the present invention, a material having a low heat conductivity is employed as a material of a heat exchanger, in place of a conventionally-employed material having a high heat conductivity such as cooper or aluminum which makes the surface temperature of the heat exchanger equal to the temperature of a refrigerant. Due to employment of a material having a low heat conductivity, a thermal gradient is produced between the refrigerant and the surface of the heat exchanger, so that the temperature at the surface of the heat exchanger becomes higher than that of the refrigerant. Some materials cause the heat exchanger to have a surface temperature close to the temperature of circulated air. That is, since the heat exchanger has an increased surface temperature, the dew-point temperature increases accordingly, so that the absolute humidity is increased. Since cooling is performed in a state in which the absolute humidity is maintained at a high level, the relative humidity is increased, and cooled air having a high humidity can be obtained.

Although the refrigerant exchanges heat in the form of sensible heat, only the temperature of circulated air can be changed without a decrease in humidity, because the surface temperature of the heat exchanger becomes higher than that of the refrigerant due to the above-described thermal gradient.

Further, since absolute humidity is not decreased, the amount of latent heat of air does not decrease, with the result that cooling can be performed to a sufficient degree even when a smaller temperature difference is produced between the inlet and outlet of the heat exchanger as compared with the case of a conventional apparatus. When the surface temperature of the heat exchanger is controlled through adjustment of the amount and speed of a refrigerant flowing through the heat exchanger, adjustment of the temperature and humidity of air becomes possible. As described above, according to the present invention, there can be obtained a cooling apparatus which can perform cooling operation at an arbitrary temperature and humidity through fine adjustment of the surface temperature of the heat exchanger.

In order to enhance the effect of latent heat, a thermal accumulating medium having a high specific heat capacity is preferably used as a refrigerant. In this case, no limitation is imposed on the material of the thermal accumulating medium.

Any material having a low heat conductivity may be used as a material for the heat exchanger. Examples of such a material include synthetic resins such as plastic, synthetic rubbers, and ceramics.

As described above, in the cooling method and cooling apparatus of the present invention, the heat exchanger has a surface temperature higher than that of a conventional heat exchanger formed of a material having a high heat conductivity such as copper or aluminum, by an amount corresponding to the thermal gradient of the material having a low heat conductivity. Therefore, cooling is effected while absolute humidity is maintained high. Therefore, a high absolute humidity is maintained within the cooling apparatus, and the amount of excess dew condensation and frost formation is decreased, with the result that the amount of energy consumption can be decreased.

BEST MODE FOR CARRYING OUT THE INVENTION

Figure 2:
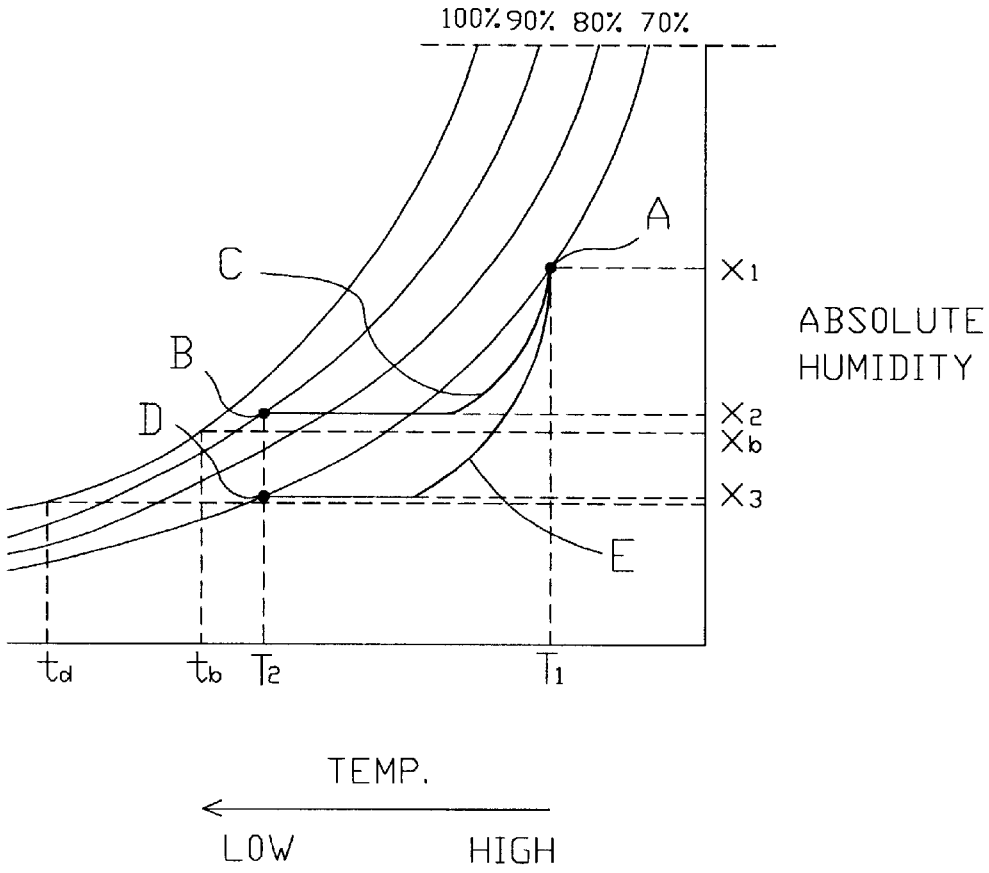
FIG. 2 is a schematic view showing a method of heat exchange in the cooling apparatus of the present invention and a method of heat exchange in the conventional cooling apparatus.

The present invention will be described in more detail with reference to the accompanying drawings. FIG. 2 is a schematic view showing heat exchange in the cooling method and cooling apparatus of the present invention. A refrigerant flows inside a heat exchanger (cooling pipe) from a refrigerant inlet 1 toward a refrigerant outlet 4. Circulated air 2—which is circulated forcibly or by means of natural convection—flows through the heat exchanger 3, which is provided within a refrigerator or room for which the cooling apparatus is provided. Heat exchange with the circulated air 2 is performed on the surface of the heat exchanger 3, so that the circulated air 2 is cooled. The heat exchanger 3 of the present invention is formed of a plastic, which is a material having a low heat conductivity, and therefore has a thermal gradient. Therefore, a difference is created between the temperature at the contact surface between the refrigerant and the heat exchanger 3 and the surface temperature of the heat exchanger 3, and thus the surface temperature of the heat exchanger 3 becomes higher than the temperature of the refrigerant. Accordingly, the dew-point temperature of the heat exchanger is decreased.

Figure 1:
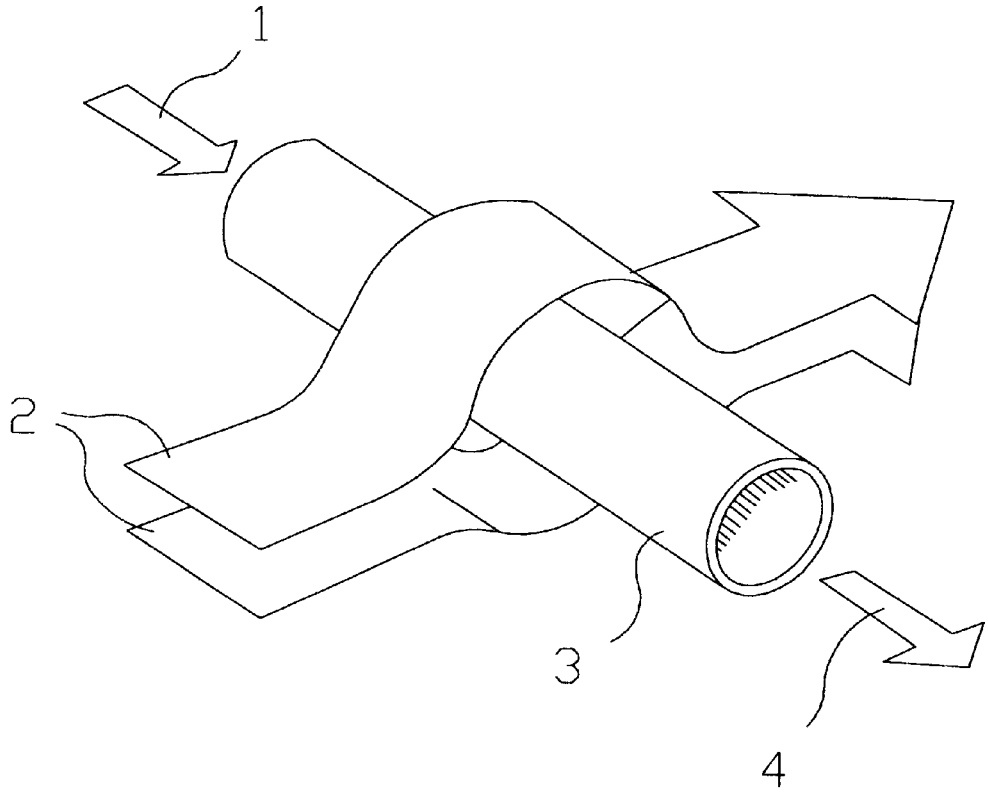
FIG. 1 shows changes on an air chart in a cooling apparatus of the present invention and in a conventional cooling apparatus.

With reference to FIG. 1, a description will be given of changes in the state of air in the heat exchanger of the present invention. FIG. 1 shows, on an air chart, changes in the cooling method and cooling apparatus of the present invention. Point A indicates a state in which air has an absolute humidity $x_1$ and a temperature $T_1$. In order to cool the air, the air is circulated such that it passes around a heat exchanger having a surface temperature $t_b$. Since the heat exchanger is formed of a material having a low heat conductivity, the surface temperature $t_b$ of the heat exchanger 3 becomes higher than the temperature $t_d$ of the refrigerant. As indicated by the solid line C, the temperature of the circulated air—which flows along the surface of the heat exchanger—changes from $T_1$ to $T_2$, while the humidity changes from $x_1$ to $x_2$, so that the air reaches an equilibrium point B. At that time, the absolute humidity of the air is decreased to a level close to a maximum water vapor amount $X_b$ at the surface temperature $t_b$ of the heat exchanger, and that state is maintained. As is apparent from FIG. 1, the maximum water vapor amount $x_b$ at the surface temperature $t_b$ of the heat exchanger of the present invention is greater than the maximum water vapor amount $x_3$ of the conventional heat exchanger whose surface temperature becomes equal to the temperature of the refrigerant.

The temperature difference between the temperature $T_2$ at the equilibrium point B and the surface temperature $t_b$ of the heat exchanger is determined in accordance with the heat conductivity and thickness of the material of the heat exchanger, the surface area of the heat exchanger, the amount of circulated air, and the amount of sensible heat of the refrigerant. In the example shown in FIG. 1, the surface temperature of the heat exchanger is substantially the same as the temperature at the equilibrium point B, so that the surface temperature of the heat exchanger is close to the dew-point temperature of the equilibrium point B. Therefore, the absolute humidity at the equilibrium point B reaches a level close to the maximum water vapor amount at the equilibrium point B, i.e., the relative humidity reaches a very high level close to 100%.

Further, in the cooling apparatus of the present invention, since a high humidity is maintained, the amount of latent heat of air is large, so that air can be cooled sufficiently even when the surface temperature of the heat exchanger is slightly lower (e.g., 2° C. lower) than a desired air temperature. That is, control can be effected even when the minimum difference between the inlet temperature and the outlet temperature of air passing through the heat exchanger is 2 to 5° C. Conventionally, it has been considered that cooling cannot be effected with such a small temperature difference. However, in the cooling method and cooling apparatus of the present invention, due to a high absolute humidity, the amount of latent heat of air increases, so that the heat exchanger can have a sufficient level of heat reception capacitance against a heat load. Therefore, cooling can be performed to a sufficient degree even when the temperature difference between the inlet temperature and the outlet temperature of air passing through the heat exchanger is small. That is, energy is not wasted. Table. 1 shows the inlet and outlet temperatures of the heat exchanger and the relative humidity in a refrigerator of the present invention that is set to 0°C.

TABLE 1

| Temp. inside refrigerator | Inlet temp. | Outlet temp. | Relative humidity |
|---|---|---|---|
| 0 ° C. | 0 ° C. | −2 ° C. | 86 ° C. |

Outside air temperature: 25 ° C.

Figure 3:
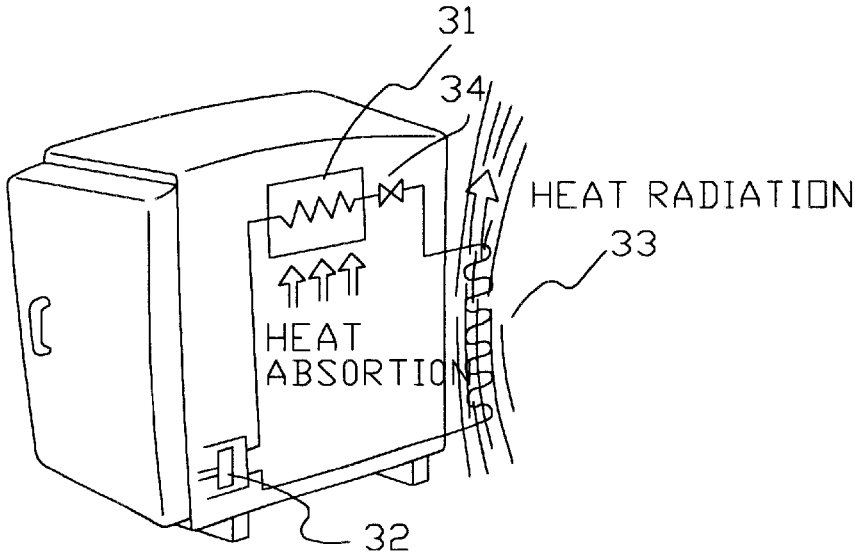
FIG. 3 is a diagram showing an example of a refrigerator in which the cooling apparatus of the present invention is used.

Next, a description will be given of a refrigerator or freezer for storing natural products and processed products in which the cooling method and cooling apparatus of the present invention is used. FIG. 3 is a schematic diagram showing a typical cooling scheme of a refrigerator. In the case of a refrigerator, a refrigerant is compressed by means of a compressor 32 so that the refrigerator becomes heated vapor having a high temperature and a high pressure. The thus-compressed refrigerant is fed to a condenser 33 disposed outside the refrigerator, and liquefies there due to heat exchange performed with air outside the refrigerator by means of convection. After passing through an expansion valve 34, the liquefied refrigerant reaches an evaporator 31, where the refrigerant is heated by air within the refrigerator and evaporates. Subsequently, the refrigerant re-enters the compressor 32. This cycle is repeated. In such a refrigerator, the refrigerant flows through a pipe in order to absorb heat from air or product inside the refrigerator. In the cooling method and cooling apparatus of the present invention, since a cooling pipe through which the refrigerant flows is formed of a material having a low heat conductivity, a temperature difference is produced between the temperature at the contact surface between the cooling pipe and the refrigerant and the surface temperature of the cooling pipe, so that the surface temperature of the cooling pipe becomes higher than the temperature of the refrigerant. As a result, the dew-point temperature of the cooling pipe is increased, and therefore, the absolute humidity is also increased. Therefore, the relative humidity reaches a high level close to 100%, so that cooling can be effected while a high humidity is maintained.

Figure 4:
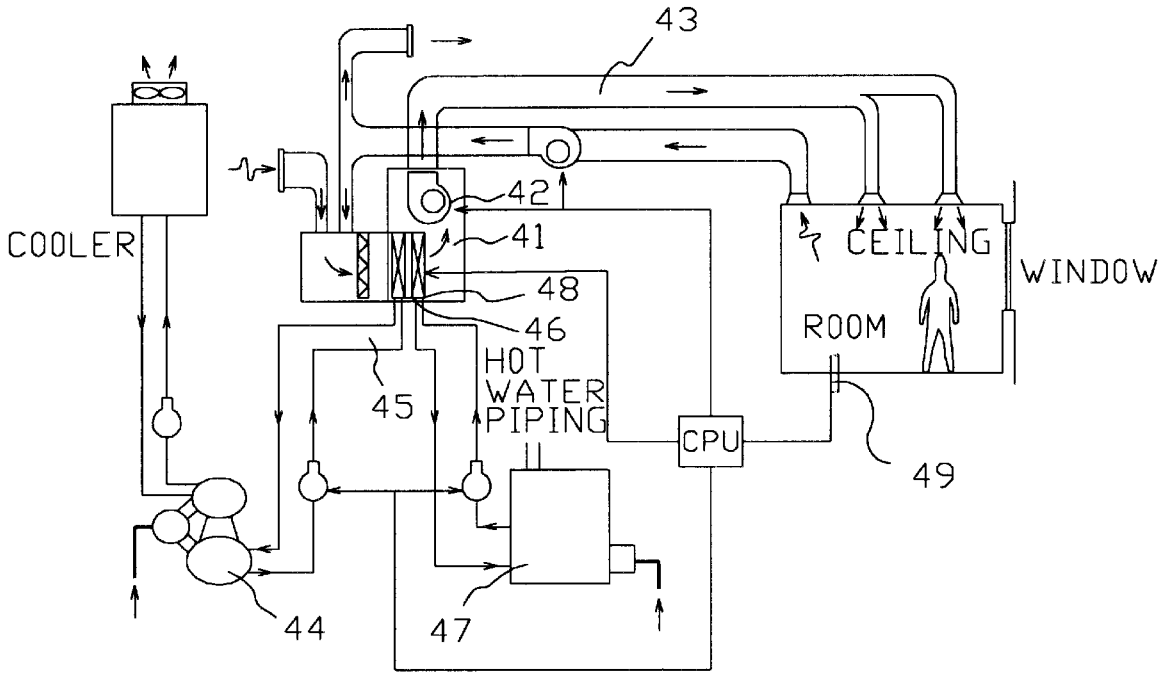
FIG. 4 is a diagram showing an example of an air conditioning facility in which the cooling apparatus of the present invention is used.

Next, a description will be given of an air conditioner for living space which is provided inside a building or a vehicle such as an automobile and in which the cooling method and cooling apparatus of the present invention is used. FIG. 4 shows a typical example of an air conditioning facility. Air that is conditioned by means of an air conditioner 41 is supplied to a living space, and a corresponding amount of air is ventilated from the living space. Thus, a flow of air is created. Air that undergoes proper purification and adjustment of temperature and humidify in the air conditioner 41 is supplied from an air supply fan 42 to the living space via an air supply duct 43 and a supply opening. When the temperature is low, in order to prevent decrease of the temperature of the space, air is heated in order to supply air having a properly elevated temperature. When the temperature is high, in order to prevent increase of the temperature of the space, air having a properly lowered temperature is supplied. A device for applying heat energy to air for heating is called a heat source 47, while a device for removing heat energy from air for cooling is called a heat sink 44. In the present embodiment, cooled water cooled by means of the heat sink 44 is supplied to a cooling unit 46 of the present invention provided in the air conditioner 41 via a cooling water pipe 45. The heat exchanger of the cooling unit 46 of the present invention is formed of a material having a low heat conductivity and has a thermal gradient. Therefore, a temperature difference is produced between the temperature at the contact surface between the heat exchanger and the refrigerant and the surface temperature of the heat exchanger, so that the surface temperature of the heat exchanger becomes higher than the temperature of the cooled water. As a result, the dew-point temperature of the heat exchanger is increased, so that cooling can be effected while a high humidity is maintained. The temperature and humidity within the living space are measured by use of a sensor 49 and the measurement data are sent to the air conditioner 41. In accordance with detection signals from the sensor, the air conditioner 41 increases and decreases the amount of cooled water supplied from the heat sink 44, regulates the amount of circulated air, and performs other controls, thereby adjust the temperature and humidity of air.

In the above descriptions in relation to cooling apparatuses for a refrigerator and a living space, a description has been given of basic specifications of a typical cooling system in which the cooling apparatus of the present invention is used. However, the cooling apparatus and cooling method of the present invention is not limited thereto, and can be applied to any kind of cooling system in which air in the form of circulated air is caused to remain around a refrigerant.

Industrial Applicability

As described above, the cooling apparatus and cooling method of the present invention are useful for cooling a refrigerator or freezer for storing natural products and processed products as well as for cooling a living space provided inside a building or a vehicle such as an automobile.

What is claimed is:

1. A method of cooling moist air having a particular dew point, said method comprising the steps of:

forming a heat exchanger having a wall, with an exterior cooling surface, and an interior chamber, said wall having substantial thickness and being formed from a material having substantial low-heat conductivity;

circulating refrigerant through said interior chamber, said refrigerant drawing heat from said wall to lower the temperature of said cooling surface to a value that is greater than the temperature of said refrigerant and no lower than or equal to said dew point;

placing said exterior cooling surface in contact with said moist air, said moist air having a temperature greater than said dew point; and cooling said moist air, via said exterior cooling surface, such that said moist air cools only to temperatures that exceed said dew point.

2. The method of claim 1, further including the step of detecting at least the temperature and/or humidity of said moist air, and wherein said step of circulating refrigerant includes the step of controlling at least the amount and/or speed of said refrigerant being circulated as a function of at least the temperature and/or humidity detected in said step of detecting at least the temperature and/or humidity of said moist air.

3. The method of claim 1, further including the step of operatively disposing said heat exchanger in a cooling space for cooling said moist air located within said cooling space.

4. The method of claim 3, wherein said step of operatively disposing said heat exchanger in a cooling space includes the step of disposing said heat exchanger in a storage container for natural products.

5. The method of claim 4, wherein said step of operatively disposing said heat exchanger in a cooling space includes the step of disposing said heat exchanger in a storage container for processed products.

6. The method of claim 3, wherein said step of operatively disposing said heat exchanger in a cooling space includes the step of disposing said heat exchanger in a living space.

7. The method of claim 6, wherein said step of disposing said heat exchanger in a living space includes disposing said heat exchanger in a vehicle such as an automobile, a ship, an airplane or the like.

8. The method of claim 6, wherein said step of disposing said heat exchanger in a living space includes disposing said heat exchanger in a fixed structure on the earth such as a building.

9. The method of claim 3, further including the step of detecting at least the temperature and/or humidity of said moist air, and wherein said step of circulating refrigerant includes the step of controlling at least the amount and/or speed of said refrigerant being circulated as a function of at least the temperature and/or humidity detected in said step of detecting at least the temperature and/or humidity of said moist air.

10. The method of claim 3, further including the step of insulating said cooling space from an ambient environment.

11. The method of claim 10, further including the step of detecting at least the temperature and/or humidity of said moist air, and wherein said step of circulating refrigerant includes the step of controlling at least the amount and/or speed of said refrigerant being circulated as a function of at least the temperature and/or humidity detected in said step of detecting at least the temperature and/or humidity of said moist air.

12. A cooling apparatus, for cooling a volume of moist air having a particular dew point, comprising:

a heat exchanger having a wall, with an exterior cooling surface, and an interior chamber, said wall having substantial thickness and being formed from a material having substantial low-heat conductivity;

support means for mounting said exterior cooling surface in contact with said volume of moist air having a temperature greater than said dew point; and circulator means for circulating a thermal accumulating medium through said interior chamber so that said thermal accumulating medium draws heat from said wall, lowering the temperature of said cooling surface to a value that is substantially greater than the temperature of said thermal accumulating medium and no lower than or equal to said dew point.

13. The apparatus of claim 12, wherein said material having substantial low-heat conductivity is a synthetic resin.

14. The apparatus of claim 12, wherein said material having substantial low-heat conductivity is a ceramic.

15. The apparatus of claim 12, wherein said material having substantial low-heat conductivity is a synthetic rubber.

16. The apparatus of claim 12, further including:

detection means for detecting at least a temperature and/or a humidity of said moist air; and control means responsive to said detection means for controlling at least the amount and/or speed of said thermal accumulating medium circulating through said interior chamber.

17. The apparatus of claim 12, wherein said thermal accumulating medium is a refrigerant.

18. The apparatus of claim 17, further including an enclosed cooling space in which said moist air and said exterior cooling surface are located.

19. The cooling apparatus of claim 18, wherein said cooling space includes a storage container for natural products.

20. The cooling apparatus of claim 18, wherein said cooling space includes a storage container for processed products.

21. The cooling apparatus of claim 18, wherein said cooling space includes a living space.

22. The cooling apparatus of claim 18, wherein said cooling space includes a living space provided in a vehicle such as an automobile, a ship, an airplane or the like.

23. The cooling apparatus of claim 18, wherein said cooling space includes a living space provided in a fixed structure on the earth such as a building.

24. The apparatus of claim 18, further including:

detection means for detecting at least a temperature and/or a humidity of said moist air; and control means responsive to said detection means for controlling at least the amount and/or speed of said refrigerant circulating through said interior chamber.

25. The apparatus of claim 18, further including a thermal insulating means for insulating said enclosed cooling space from an ambient environment.

26. The apparatus of claim 25, further including:

detection means for detecting at least a temperature and/or a humidity of said moist air; and control means responsive to said detection means for controlling at least the amount and/or speed of said refrigerant circulating through said interior chamber.

* * * * *